US007037044B2

(12) United States Patent
Xu et al.

(10) Patent No.: US 7,037,044 B2
(45) Date of Patent: May 2, 2006

(54) DECK-TO-COLUMN CONNECTION FOR EXTENDABLE DRAFT PLATFORM

(75) Inventors: Qi Xu, Katy, TX (US); Phillip Andrew Abbott, Katy, TX (US)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 10/950,700

(22) Filed: Sep. 27, 2004

(65) Prior Publication Data

US 2005/0084336 A1 Apr. 21, 2005

Related U.S. Application Data

(60) Provisional application No. 60/511,380, filed on Oct. 15, 2003.

(51) Int. Cl.
*E02B 17/00* (2006.01)

(52) U.S. Cl. ..... 405/200; 405/196; 405/223.1; 114/264; 114/265

(58) Field of Classification Search ..... 405/196, 405/197, 198, 199, 200, 203, 204, 205, 223.1; 114/264, 265, 256
See application file for complete search history.

(56) References Cited

U.S. PATENT DOCUMENTS

| | | | | |
|---|---|---|---|---|
| 3,118,283 | A * | 1/1964 | True et al. | 405/200 |
| 3,605,669 | A * | 9/1971 | Yu | 405/200 |
| 4,735,526 | A * | 4/1988 | Kawagoe et al. | 405/196 |
| 6,024,040 | A * | 2/2000 | Thomas | 114/264 |
| 6,718,901 | B1 * | 4/2004 | Abbott et al. | 114/264 |

* cited by examiner

*Primary Examiner*—Frederick L. Lagman
(74) *Attorney, Agent, or Firm*—Klein, O'Neill & Singh, LLP; Howard J. Klein

(57) ABSTRACT

An extendable draft platform, having a deck and buoyancy columns installed in leg wells in the deck for vertical movement from a raised position to a submerged position, includes a connection arrangement for securing the columns to the deck when the columns are in the submerged position. In the connection arrangement, a plurality of first guide elements near the top of each column is engageable by a plurality of complementary second guide elements secured to the deck around each leg well when the column is lowered to its submerged position. A locking mechanism is operable between the columns and the deck when the first guide elements are engaged with the second guide elements. The first and second guide elements may be configured so that the connection between the deck and the columns may be enhanced by over-ballasting the columns and/or by welding the columns to the deck.

30 Claims, 9 Drawing Sheets

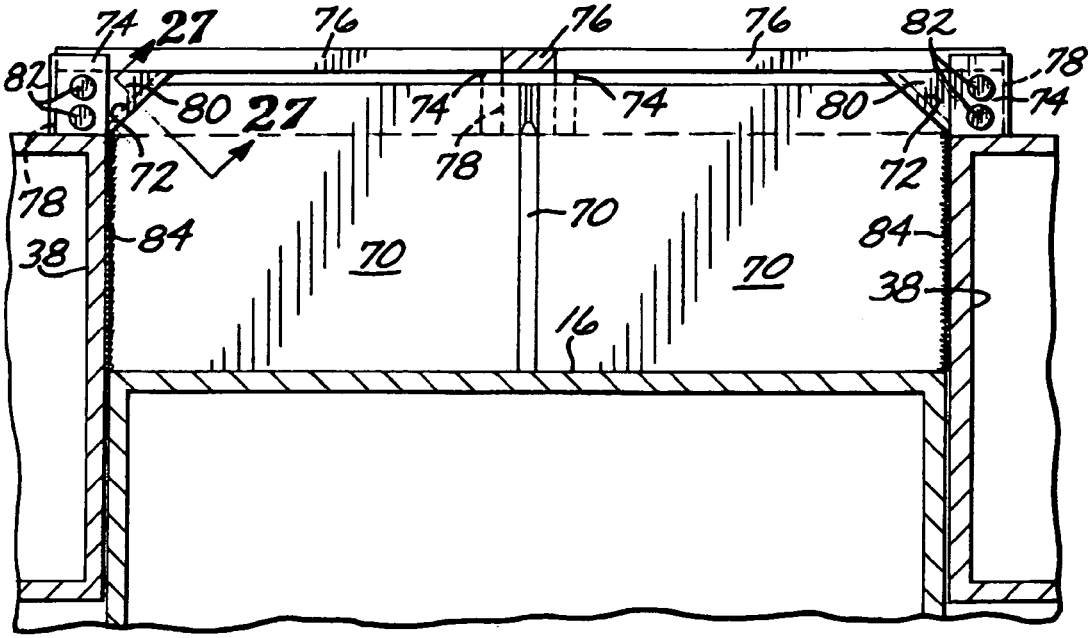
FIG.25
FIG.27
FIG.26
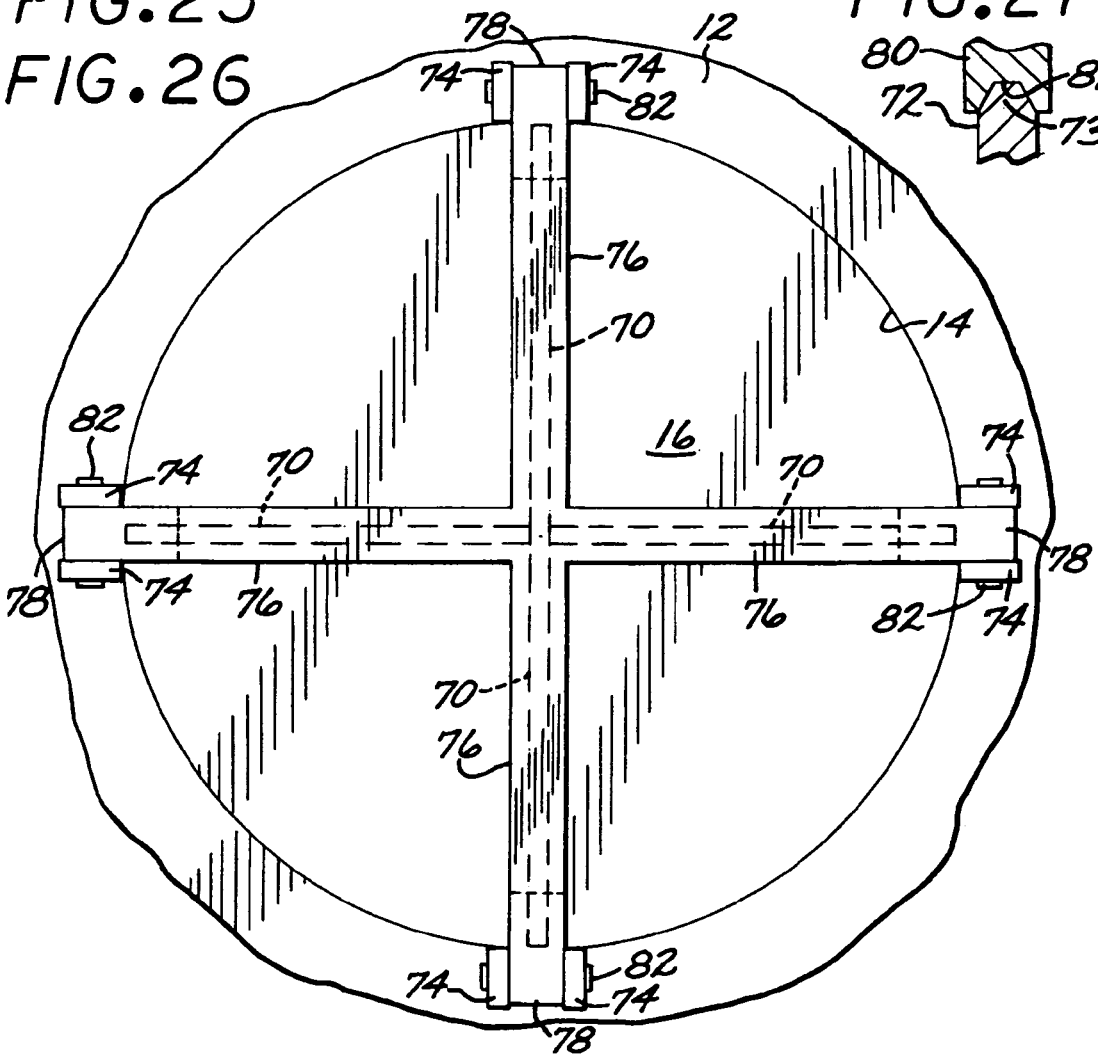

DECK-TO-COLUMN CONNECTION FOR EXTENDABLE DRAFT PLATFORM

CROSS-REFERENCE TO RELATED APPLICATION

This application claims the benefit, under 35 U.S.C. §119(e), of the filing date of co-pending provisional application No. 60/511,380; filed Oct. 15, 2003, the disclosure of which is incorporated herein by reference.

FEDERALLY SPONSORED RESEARCH OR DEVELOPMENT

Not Applicable

BACKGROUND OF THE INVENTION

This invention relates to the field of deep-draft semi-submersible offshore platforms for the drilling of oil wells and natural gas wells and the production of oil and or gas from such wells. Specifically, the present invention relates to a type of deep-draft semi-submersible platform known as an extendable draft platform, or "EDP." More particularly, the present invention relates to mechanisms and arrangements for the connection of a plurality of buoyancy columns to a floating deck of the platform.

The development of deep water offshore oil and gas fields, such as are found in the Gulf of Mexico and the North Sea, present substantial challenges to the industry. Early production schedule requirements favor inshore integration and commissioning and a year-round deployment capability. Moreover, the ability to use so-called "dry trees" and steel catenary risers ("SCRs") requires that the motion of the deployed structures be relatively small, even in rough seas.

In response to these challenges, a number of different types of tethered, floating platforms have been proposed for use in offshore oil and gas exploration and production, such as are described in the following patent publications: U.S. Pat. No. 6,024,040; U.S. Pat. No. 6,196,767; and U.S. Pat. No. 6,524,032. The teachings of these publications are incorporated herein by reference.

One type of offshore platform that has met with commercial success in deep water applications is the semi-submersible platform. Conventional semi-submersible platforms, however, are subject to motions that make it difficult, or even impossible, to support the various types of risers that are employed in such platforms. Deep draft semi-submersible platforms have been proposed that would exhibit superior motion characteristics. One type of deep draft semi-submersible platform is known as the extendable draft platform, or "EDP." The typical EDP comprises a buoyant equipment deck having a plurality of openings ("leg wells") through the deck. The deck may conveniently be rectangular or triangular, with a leg well at each corner or apex, although other configurations may be used. Installed in each of the leg wells is a buoyancy column that can be ballasted (e.g., with seawater). The columns are initially installed in a raised position, and then lowered to a submerged position when the EDP has been moved to a deep water site. Each column is divided by transverse internal bulkheads and horizontal flats (decks) into a plurality of compartments, the compartments including means for introducing water into them for ballasting purposes when the columns are lowered to their submerged positions. Attached to the bottom of the columns is a heave plate pontoon assembly that helps to stabilize the EDP against the heave action of waves and swells. Examples of prior art EDPs are disclosed in U.S. Pat. No. 6,718,901—Abbott et al. and U.S. Pat. No. 6,024,040—Thomas, the disclosures of which are incorporated herein by reference.

Once the columns are lowered to their submerged position, the tops of the columns must be securely fixed to the deck. It is important that the attachment or connection of the columns to the deck be secure enough to withstand the strong forces that current and waves often apply to the EDP. The attachment or connection mechanism must also allow the downward movement of the column relative to the deck as the column is moved to its submerged position prior to the attachment or connection of the column to the deck. In other words, the attachment or connection mechanism must not interfere with the column lowering process. While prior art approaches (such as rack-and-pinion lowering systems which can be locked in various ways) have provided satisfactory results, further improvements in the connection/attachment mechanisms have been sought, so as better to achieve the intended results, particularly when a rack-and-pinion lowering system is not employed.

SUMMARY OF THE INVENTION

The present invention is an arrangement for securing the deck of an EDP to a buoyancy column that is installed in a leg well in the deck for vertical movement within the leg well from a raised position to a submerged position. Broadly, the arrangement comprises a plurality of first guide elements near the top of each column; a plurality of complementary second guide elements secured to the deck around the leg well, each of which is configured to engage an associated one of the first guide elements when the column is lowered to its submerged position; and a locking mechanism that is operable on the upper portion of the column to restrict the motion of the column relative to the deck when the first guide elements are engaged with the second guide elements.

In a first exemplary embodiment, the arrangement comprises a first plurality of radial bulkheads extending vertically from the top of the column, each of which includes a radially-extending first guide element; a plurality of complementary second guide elements on the deck around the periphery of the leg well and positioned to engage the first guide elements when the column is lowered to its submerged position; a second plurality of radial bulkheads extending vertically from the top of the column, each of which carries a radially-extending locking pin that is radially movable between a withdrawn position and an extended position; and a plurality of pin receptacles on the deck around the periphery of the leg well, located so as to receive the pins when the first guide elements are engaged by the second guide elements and the locking pins are moved to their extended position. In this embodiment, the locking mechanism comprises the locking pins and the mating pin receptacle. In this embodiment, the columns are advantageously over-ballasted so that the first guide elements firmly press down on the second guide elements, whereby the columns and the deck will move as one body in response to environmental forces (e.g., waves, currents, and wind).

In a second exemplary embodiment, the arrangement comprises a first plurality of radial bulkheads extending vertically from the top of the column, each of which includes a radially-extending first guide element; a plurality of complementary second guide elements on the deck around the periphery of the leg well and positioned to receive the first guide elements when the column is lowered to its submerged position; a second plurality of radial bulkheads extending vertically from the top of the column, each of which carries a radial extension member; a plurality of U-shaped receptacles or brackets on the deck around the periphery of the leg well, located so as to receive the extension members when the column is lowered to its submerged position; and a locking pin operatively associated with each of the brackets and movable between an unlocked position and a locked position in which the extension member is locked into the bracket in which it is received. In this embodiment, the locking mechanism comprises the extension members, the brackets, and the locking pins. This embodiment also advantageously includes the over-ballasting of the columns mentioned above.

In a third exemplary embodiment, the arrangement comprises a plurality of radial beams fixed to the top of each column, each of the beams having first guide element in the form of a sloped or angled shoulder on its underside at its end remote from the center; a plurality of stop elements fixed to the peripheral wall of the leg well, each having a sloped or angled upper surface forming a second guide element, and a sloped or angled lower surface. The stops are located so that the upper surfaces thereof are engageable with the shoulders of the beams when the column is lowered to its submerged position. A plurality of radially-extending shear keys is disposed on the top of the column. Each of the shear keys extends radially underneath one of the radial beams, and is movable between a radially withdrawn position and a radially extended position. The shear keys are actuated by conventional means, such a pneumatic cylinder, a hydraulic cylinder, or a jack screw, and they are held in their withdrawn position as the column is lowered so that they can clear the stop elements. Once the column has reached its submerged position, the shear keys are moved to their extended position in which they engage the lower surfaces of the stops. In this embodiment, the locking mechanism comprises the beam shoulders, the stops, and the shear keys. The over-ballasting of the columns is also advantageously used in this embodiment.

In a fourth exemplary embodiment, the arrangement comprises a plurality of radial bulkheads extending vertically from the top of the column; a plurality of brackets arranged around the opening of the leg well on the deck surface and located so as to correspond with the circumferential positions of the bulkhead ends; a cap beam dimensioned to bridge the leg well opening, the cap beam defining a plurality of radial arms circumferentially located so as to correspond with the radial bulkheads, each of the arms having an end that is received in one of the brackets; and at least one locking pin operatively associated with each of the brackets and movable between an unlocked position and a locked position in which each cap beam arm end is locked into the receptacle in which it is received. Each of the bulkheads has a sloped or chambered shoulder at each end that forms a first guide element, and each cap beam arm has a complementary angled brace on its underside near its end that forms a second guide element. The column is deballasted to lift it into a position in which the sloped shoulders of the bulkheads engage against the angled braces on undersides of the cap beam arms, in which position the deck is slightly up-lifted. The column bulkheads are optionally welded to the deck wall surrounding the leg well. In this embodiment, the locking mechanism comprises the cap beam, the brackets, and the locking pins, (and, optionally, the bulkhead-to-deck wall weld), but in this case, the locking mechanism limits only the upward movement and rotation of the column relative to the deck.

BRIEF DESCRIPTION OF THE DRAWINGS

FIG. 25 is a cross-sectional view, similar to that of FIG. 24, but showing the assembly after the column has been deballasted (raised) to its connection position;

FIG. 26 is a top plan view of the assembly of FIG. 25; and

FIG. 27 is a cross-sectional view taken along line 27—27 of FIG. 25.

DETAILED DESCRIPT OF THE INVENTION

Figure 1:
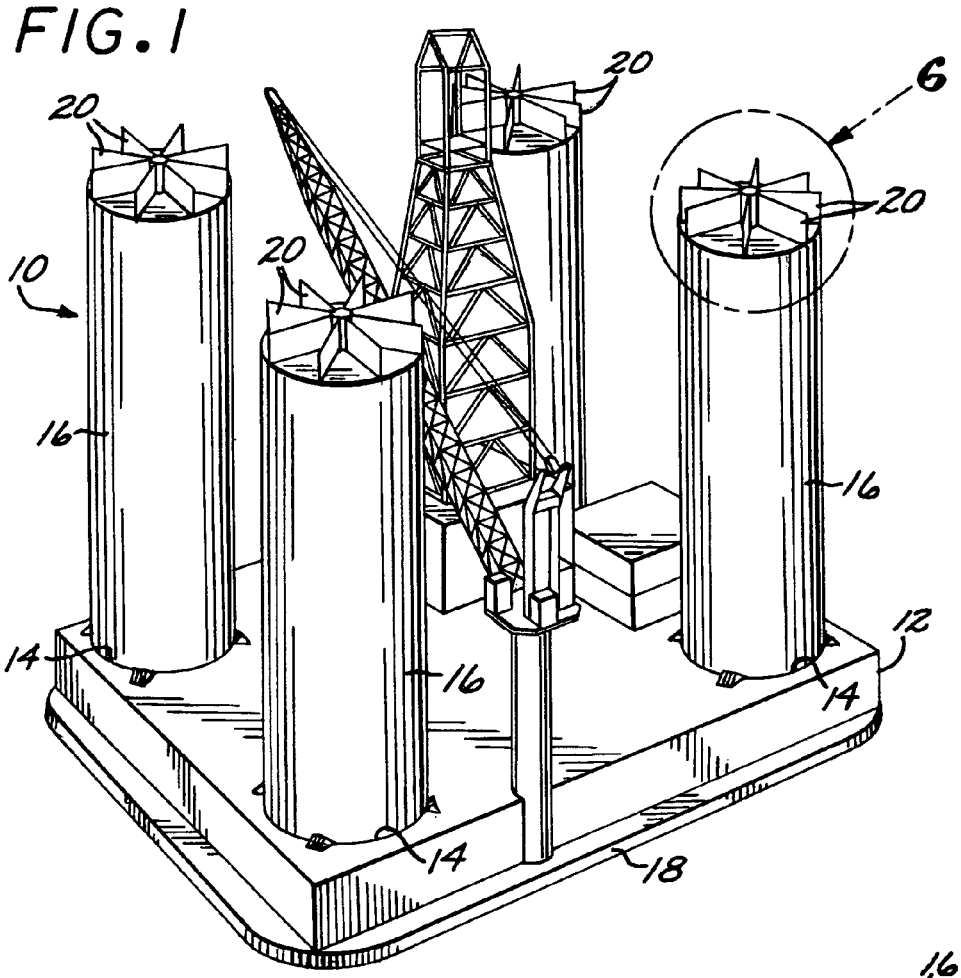
FIG. 1 is a perspective view of an extendable draft platform ("EDP") incorporating a deck-to-column connection assembly in accordance with the present invention.
Figure 2:
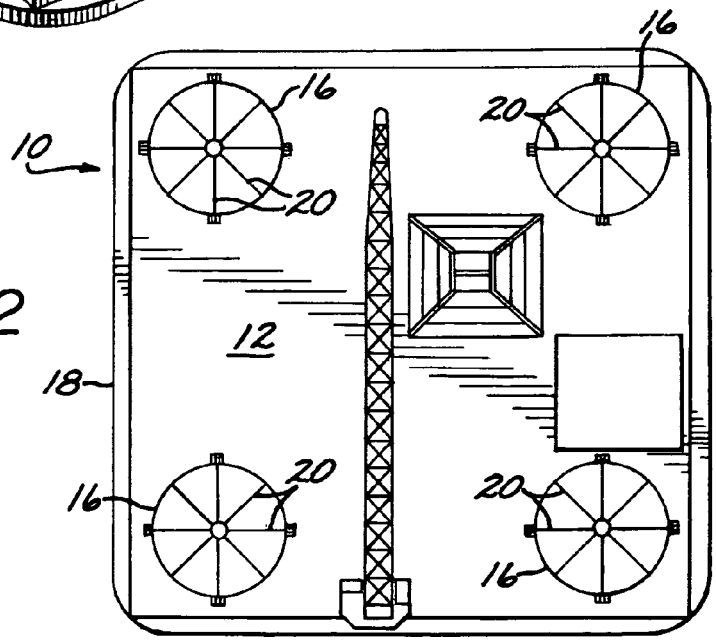
FIG. 2 is a top plan view of the EDP of FIG. 1.

Referring first to FIGS. 1 and 2, an extendable draft platform ("EDP") 10 includes a deck-to-column connection assembly in accordance with the present invention. The EDP 10 includes a buoyant deck 12 on which conventional equipment and structures for the exploration and/or production of undersea oil and/or gas are mounted. The deck 12 is typically rectangular or square, as shown, but it may be any convenient shape. The deck is provided with a plurality of leg wells 14 which, in a deck 12 that is rectangular or triangular, are typically located near the corners or apices of the deck. Each of the leg wells 14 accommodates a column 16 that is disposed within the leg well 14 for vertical movement therein between a raised position (shown in FIG. 1) and a lower (submerged) position. The columns 16 are of conventional design, being internally divided by transverse bulkheads (not shown) into a plurality of compartments (not shown). A ballasting mechanism (not shown) is provided for each column 16 for selectively introducing water into the compartments to lower the column, and removing (deballasting) water therefrom to raise the column. A heave plate 18 is attached to the bottoms of the columns 16 to move up and down relative to the deck 12 as the columns are raised and lowered.

In several of the exemplary embodiments discussed below, an arrangement of radial bulkheads 20 is fixed to the top surface of each column 16. The bulkheads 20 extend vertically, and form part of the deck-to-column connection assembly, as described below.

Figure 3:
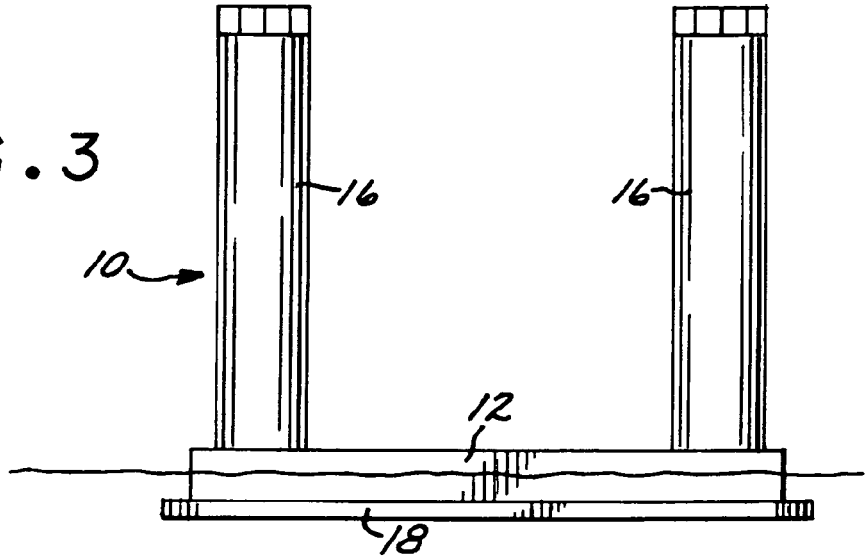
FIGS. 3, 4, and 5 are simplified elevational views of the EDP of FIG. 1, showing the steps involved in lowering the columns to their submerged position at a deep water site.
Figure 4:
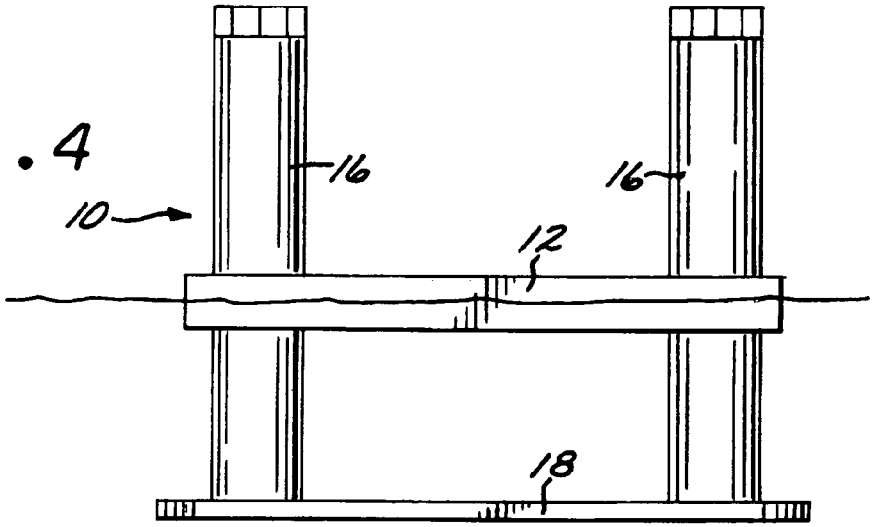
Figure 5:
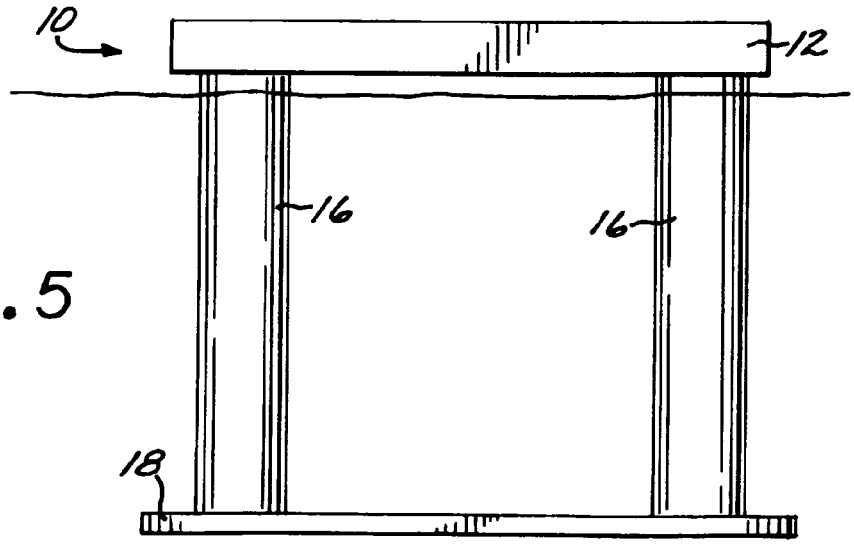

FIGS. 3, 4, and 5 illustrate the process of lowering of the columns 16. Specifically, FIG. 3 shows the columns 16 in their fully-raised position. In this position, their internal compartments are devoid of water (deballasted), and the heave plate 18 is in its uppermost position adjacent the bottom of the deck 12. This is the position the columns 16 are in when the EDP 10 is in shallow water and while the EDP is being towed to a selected site in a deeper body of water in which it is to be installed. FIG. 4 shows the columns 16 in the process of being lowered by filling their compartments with water ballast. FIG. 5 shows the columns 16 in their fully submerged position, that is, at their lowermost limit of travel within the leg wells, in which their lowermost compartments are completely filled with water ballast, and at least some of their intermediate compartments are at least partially filled with water ballast. The heave plate 18 is now fully deployed in its lowermost position, the deck 12 is lifted above the surface of the water, and the EDP 10 is in its operating configuration. When the columns 16 are in their submerged position, they are rigidly connected to the deck 12 by the deck-to-column connection assembly in accordance with the present invention, as described below.

Figure 6:
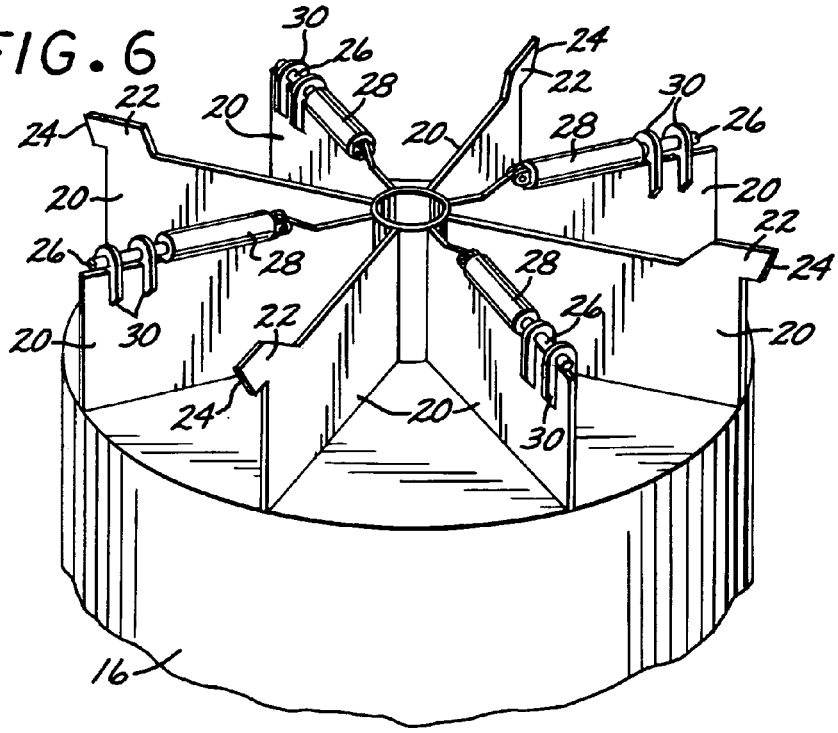
FIG. 6 is a perspective view of the top of a column, taken within the broken outline labeled "6" in FIG. 1, showing the column-mounted components of the deck-to-column connection assembly in accordance with a first exemplary embodiment of the invention.

FIGS. 6 through 11 illustrate a deck-to-column connection assembly in accordance with a first exemplary embodiment of the invention. In FIG. 6, the top portion of a column 16 is shown. As mentioned above, an array of radial bulkheads 20 is fixed to, and extends vertically from the top surface of the column 16. Eight such bulkheads 20 are shown, but any number, preferably between four and eight, sufficient to perform the connection function described below, may be used. As shown, each of four alternating bulkheads 20 has a first guide element 22 extending radially outwardly from the end of the bulkhead 20 remote from the center of the column. Each of the first guide elements 22 has a sloped or angled end 24 that angles radially inwardly from top to bottom. On the top of each of the remaining (alternating) four bulkheads, a locking pin mechanism is mounted. The locking pin mechanism comprises a locking pin 26 that is driven, by a pneumatic or hydraulic cylinder 28, between a withdrawn position (shown in FIG. 6) and an extended position (see FIG. 8). The pin 26 may advantageously be journaled in one or more bearing guides 30 fixed to the top edge of the bulkhead 20.

Figure 7:
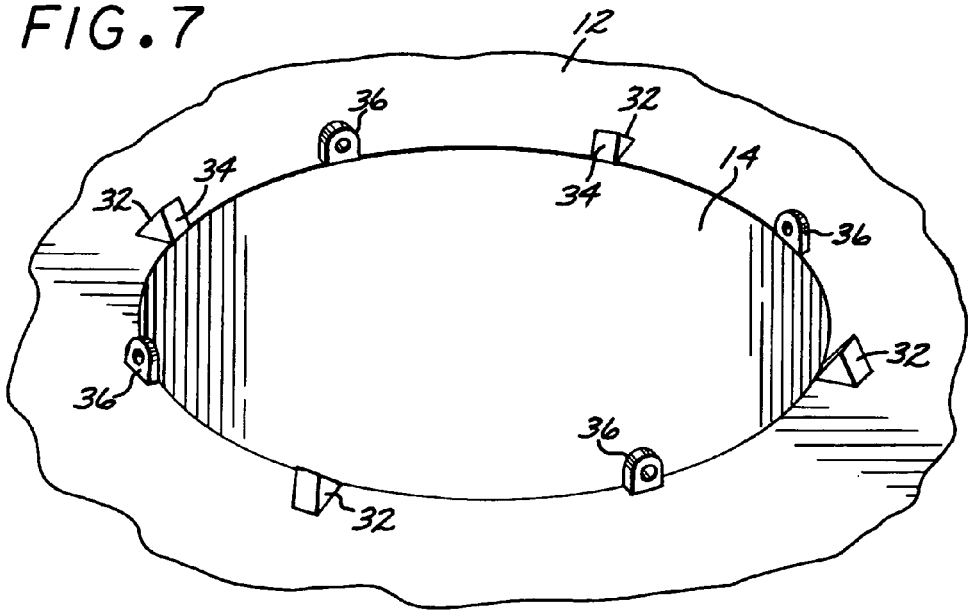
FIG. 7 is a perspective view of a portion of the deck of the EDP and the deck-mounted components of the deck-to-column connection assembly in accordance with a first exemplary embodiment of the invention.
Figure 8:
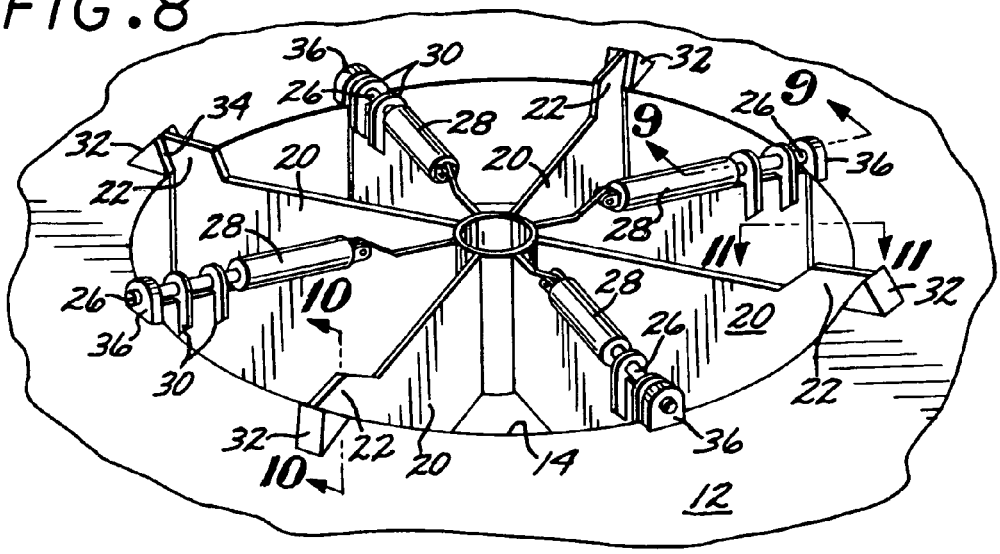
FIG. 8 is a perspective view of the column of FIG. 6 connected to the deck of FIG. 7 by the deck-to-column connection assembly in accordance with a first exemplary embodiment of the invention.
Figure 10:
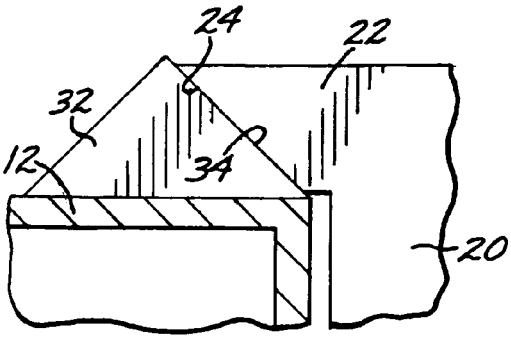
FIG. 10 is a cross-sectional view taken along line 10—10 of FIG. 8.

FIG. 7 shows a portion of the deck 12 adjacent the leg well 14 in which the column 16 of FIG. 6 is installed. Mounted on the deck 12 around the periphery of the leg well 14 is a plurality of second guide elements 32, each of which is located circumferentially so as to be engageable with an associated one of the first guide elements 22 described above. Each of the second guide elements 32 has a front surface 34 that is sloped at an angle that is complementary to the angle of the angled ends 24 of the first guide elements 22, as shown in FIG. 10. Also mounted on the deck 12 around the periphery of the leg well 14 is a plurality of locking pin receptacles 36, each of which is circumferentially located so as to receive an associated one of the locking pins 26 when the latter is in its extended position.

Figure 9:
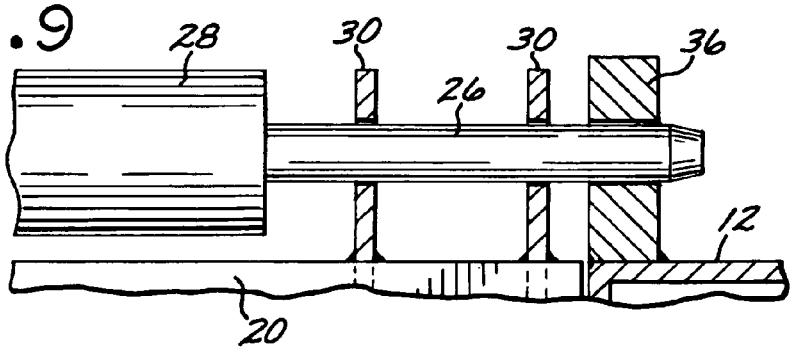
FIG. 9 is a cross-sectional view taken along line 9—9 of FIG. 8.
Figure 11:
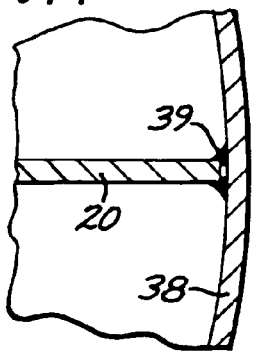
FIG. 11 is a cross-sectional view taken along line 11—11 of FIG. 8.
Figure 12:
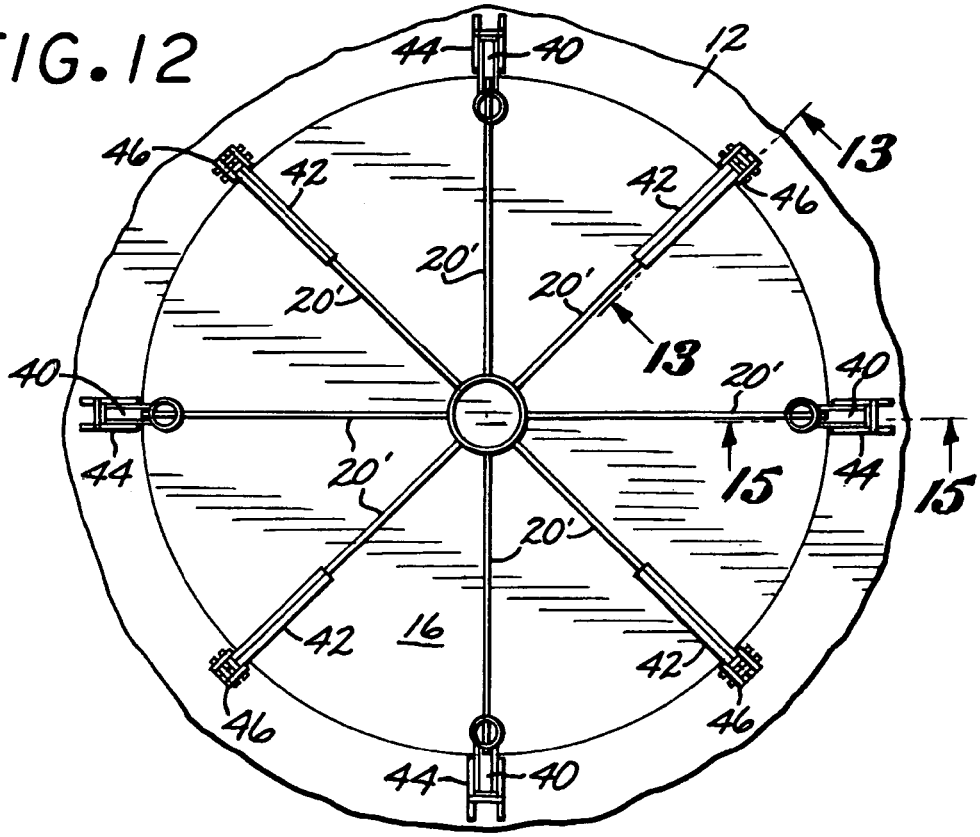
FIG. 12 is a top plan view of a deck-to-column connection assembly in accordance with a second exemplary embodiment of the present invention.
Figure 13:
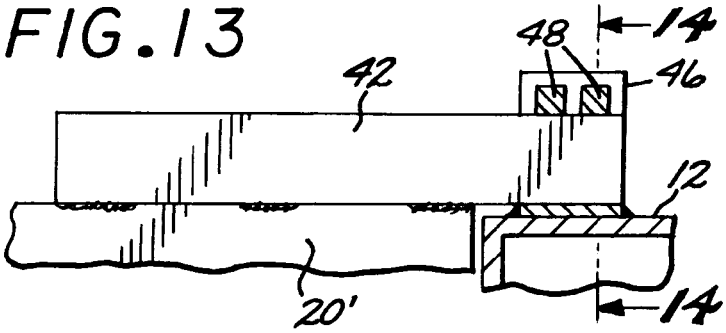
FIG. 13 is a cross-sectional view taken along line 13—13 of FIG. 12.
Figure 14:
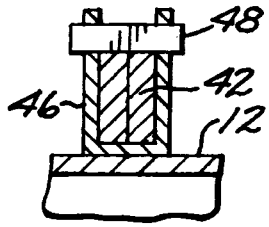
FIG. 14 is a cross-sectional view taken along line 14—14 of FIG. 13.

FIGS. 8 through 11 show one of the EDP's several columns 16 connected to the deck 12 by means of the deck-to-column connection assembly in accordance with a first exemplary embodiment of the invention. Specifically, the column 16 has been lowered to its submerged position by ballasting its compartments, as described above, until the first guide elements 22 abut against and engage the second guide elements 32, as shown in FIG. 10. The engagement of the first and second guide elements with their complementary angles serves to center the columns 16 properly in their respective leg wells. The columns 16 may advantageously be over-ballasted to apply a compressive or stressed engagement between the first guide elements 22 and the second guide elements 32, thereby better assuring that the columns 16 and the deck 12 move as one body in response to environmental forces. The locking pins 26 are then moved to their extended positions in which they are received in the pin receptacles 36, as best shown in FIG. 9. When the column 16 is thus locked into its submerged position relative to the deck 12, the deck 12 is lifted above the surface of the water. In this position, the radially outer edges of the bulkheads 20 are advantageously welded to the interior wall 38 of the leg well 14, as shown in FIG. 11, along a weld joint 39.

FIGS. 12 through 16 illustrate a deck-to-column connection assembly in accordance with a second exemplary embodiment of the invention. As in the first embodiment described above, this embodiment includes an array of radial bulkheads 20' extending vertically from the top surface of the column 16. As mentioned above, although eight bulkheads 20' are shown, any other suitable number may be used. As shown, each of four alternating bulkheads 20' terminates, at its radially outer end, in a first guide element 40, which is advantageously configured as a rounded, trough-like fixture. Each of the other four alternating bulkheads 20' has a radial extension element 42 fixed to its top edge. Each of the extension elements 42 extends radially beyond the radially outer end of its associated bulkhead 20'.

Figure 15:
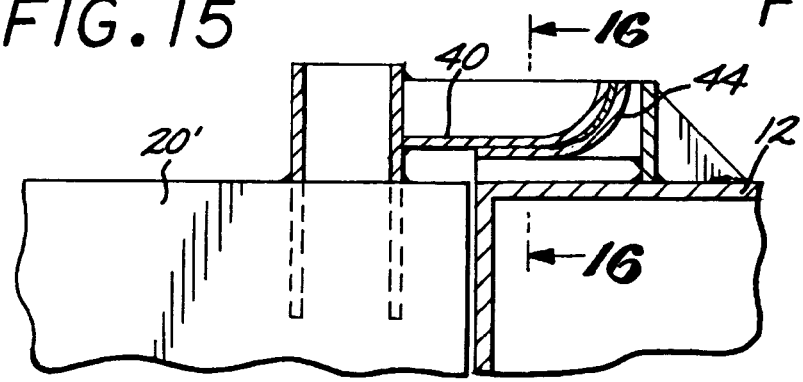
FIG. 15 is a cross-sectional view taken along line 15—15 of FIG. 12.
Figure 16:
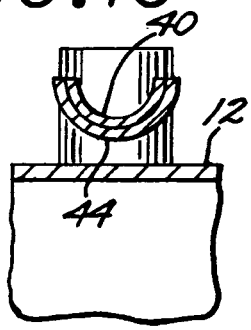
FIG. 16 is a cross-sectional view taken along line 16—16 of FIG. 15.
Figure 17:
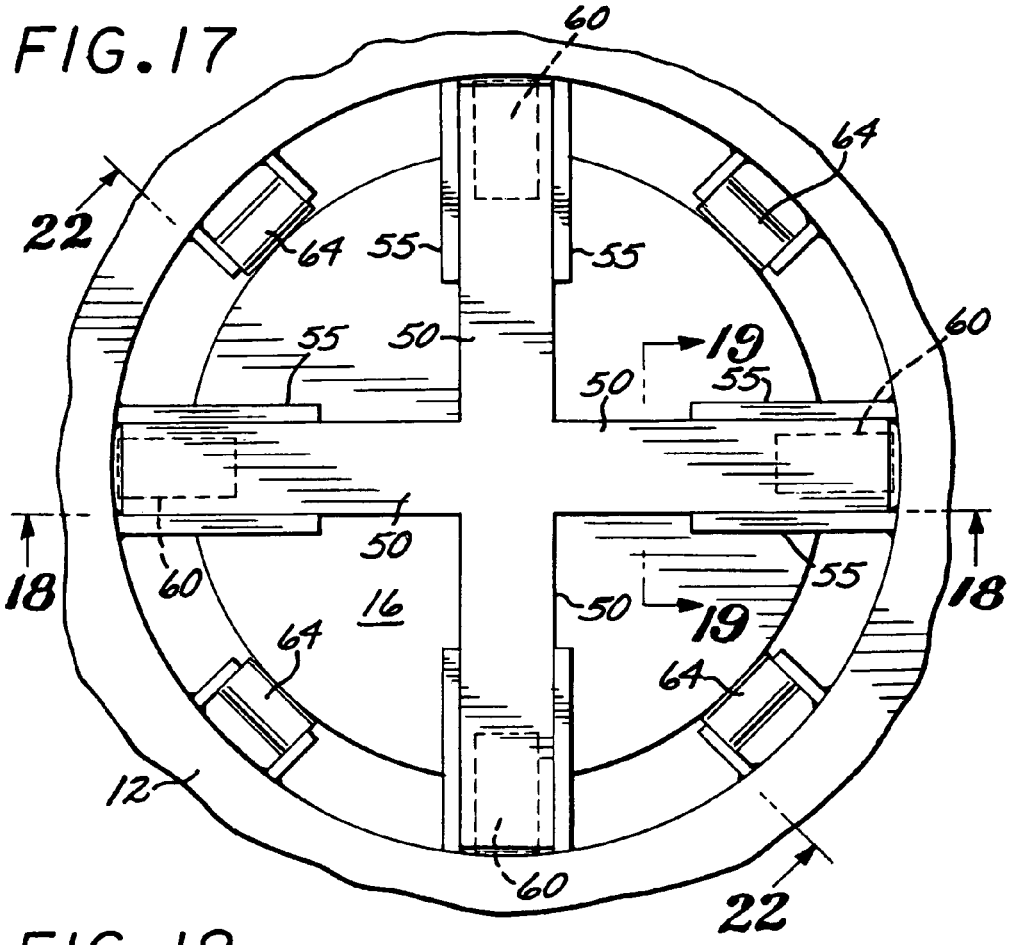
FIG. 17 is a top plan view of a deck-to-column connection assembly in accordance with a third exemplary embodiment of the present invention.

Mounted on the deck 12 around the periphery of the leg well 14 is a plurality of second guide elements 44, each of which is located circumferentially so as to be engageable with an associated one of the first guide elements 40 described above. Preferably, each of the second guide elements 44 has a rounded, concave configuration in which its associated first guide element 40 seats or nests concentrically, as shown in FIGS. 15 and 16, when the column 16 is lowered to its submerged position. Also mounted on the deck 12 around the periphery of the leg well 14 is a plurality of U-shaped extension element receptacles or brackets 46, each of which is circumferentially located so as to receive an associated one of the extension elements 42 when the column 16 is lowered to its submerged position.

When the column 16 is lowered to its submerged position, as mentioned above, the first guide elements 40 are seated in the complementary second guide elements 44, and the extension elements 42 are received in the receptacles or brackets 46, thereby assuring the proper centering of the column in the leg well. Preferably, as with above-described first embodiment, the column 16 is over-ballasted to apply a compressive or stressed engagement between the first and second guide elements 40, 44, and between the extension elements 42 and the brackets 46. The upraised legs of the brackets 46 are provided with holes through which is journaled at least one locking pin 48, and preferably two locking pins 48, as shown. The locking pins 48 are shown in a locking position in which they extend through their respective brackets 46 across the top of the extension element 42 received in each bracket 46, so as to lock each of the extension elements 42 into its associated bracket 46. The locking pins 48 may advantageously be driven by conventional hydraulic or pneumatic mechanisms (not shown). As in the first embodiment, once the column 16 and the deck 12 are thus locked together, the deck 12 is lifted above the surface of the water. Again, the outer edges of the bulkheads 20' may advantageously be welded to the surrounding leg well wall 38.

Figure 18:
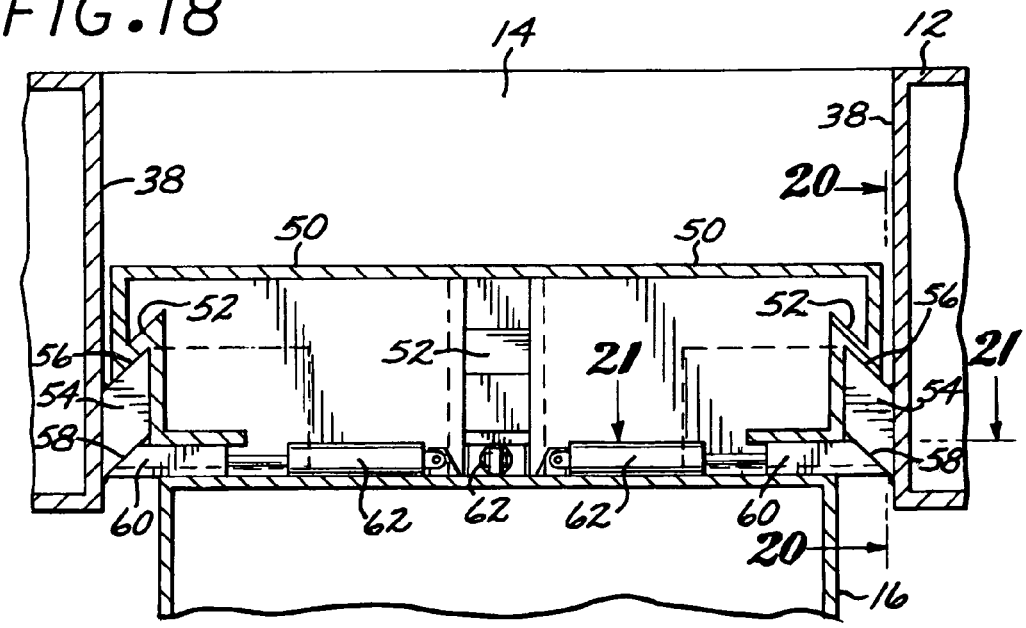
FIG. 18 is a cross-sectional view taken along line 18—18 of FIG. 17.
Figure 19:
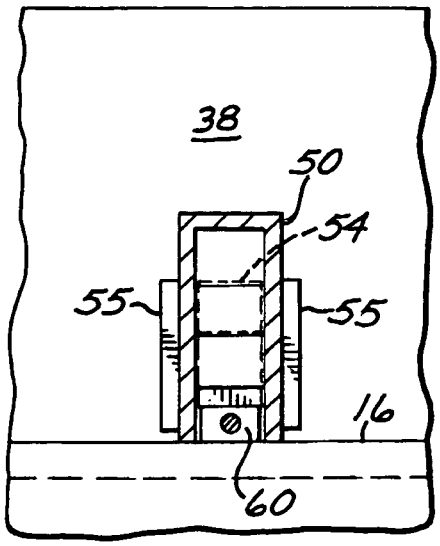
FIG. 19 is a cross-sectional view taken along line 19—19 of FIG. 17.
Figure 20:
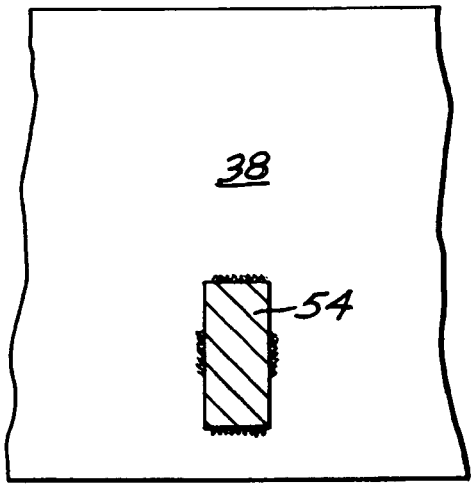
FIG. 20 is a cross-sectional view taken along line 20—20 of FIG. 18.
Figure 21:
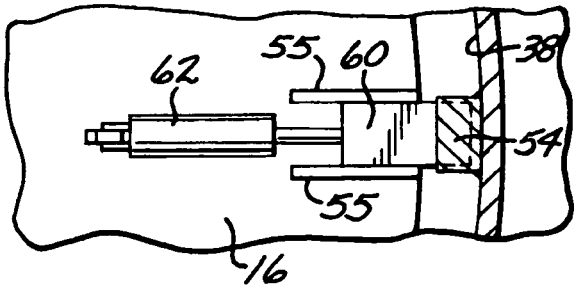
FIG. 21 is a cross-sectional view taken along line 21—21 of FIG. 18.
Figure 22:
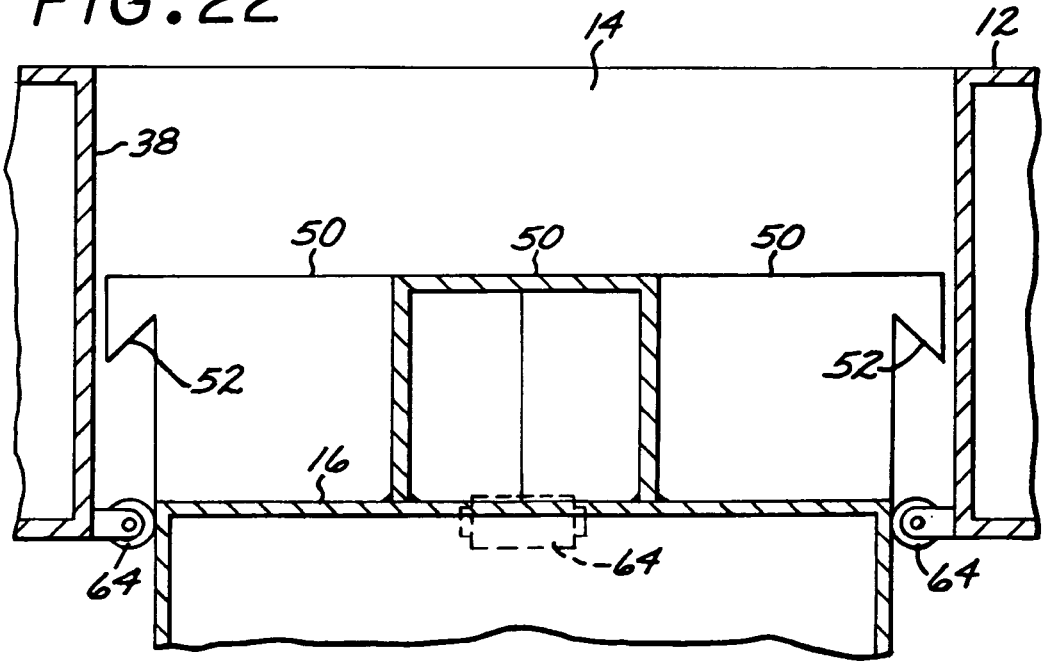
FIG. 22 is a cross-sectional view taken along line 22—22 of FIG. 17.

FIGS. 17 through 22 illustrate a third exemplary embodiment of the invention. In this embodiment, a plurality of radial beams or arms 50 is fixed to the top of each column 16, each of the beams 50 having a reverse-angled shoulder forming a first guide element 52 on its underside at its end remote from the center. In a preferred form of this embodiment, as shown in the drawings, four beams or arms 50 are arranged in cruciform, each of the beams or arms 50 having a radial outer end configured with an angled first guide element 52. Preferably, the first guide element 52 is formed with a reverse, or undercut, angle, as shown in FIGS. 18 and 22, to form a hook-like configuration, but an angle that slopes radially inwardly from top to bottom may also be used. A plurality of stops 54 that serve as second guide elements is fixed to the interior peripheral wall 38 of the leg well 14, located between a pair of upright radial guide walls 55 that extend radially inwardly from the peripheral wall 38. The stops or second guide elements 54 are located circumferentially at positions corresponding to the positions of the first guide elements 52. Each of the second guide elements 54 has an upper surface 56 that is formed with an angle that is complementary to the angle of the first guide elements 52, and an upwardly-sloped or angled lower surface 58. Thus, in the illustrated embodiment, each second guide element resembles a parallelogram in side elevation. The second guide elements 54 are located so that the first guide elements 52 of the beams 50 engage with the upper surfaces 56 of the corresponding second guide elements 54 when the column 16 is lowered to its submerged position, as shown in FIG. 18, thereby facilitating the proper centering of the column in the leg well. As with the previously-described embodiments, over-ballasting of the columns 16 provides a stressed or compressive engagement between the first guide elements 52 and the second guide elements 54, so as to provide a more secure locking of the columns to the deck.

A plurality of shear keys 60 is disposed on the top of the column 16, one of the shear keys 60 being located underneath each end of each of the beams 50. The shear keys 60 are movable between a radially withdrawn position and a radially extended position by actuation means 62, which may be pneumatic or hydraulic cylinders or jack screws. The shear keys 60 are held in their withdrawn position as the column 16 is lowered so that they can clear the stops or second guide elements 54. Once the column 16 has reached its submerged position, the shear keys 60 are moved to their extended position in which they engage the lower surfaces 58 of the stops or second guide elements 54, thereby locking the column 16 in place in its submerged position relative to the deck 12.

As shown in the drawings, each of the shear keys 60 has an angled, wedge-shaped bearing surface that is complementary to the angled lower surface 58 of the second guide elements 54, but the angle illustrated in the drawings is exaggerated for clarity, and is actually much shallower than depicted. Also, as shown in the drawings, a plurality of rollers 64 may advantageously be provided around the lower periphery of the leg well 14 to facilitate the vertical movement of the column 16 therein. Such rollers 64 (or equivalent devices) may be employed in any of the embodiments of the invention.

A fourth exemplary embodiment is shown in FIGS. 23 through 27. In this embodiment, the deck-to-column connection arrangement comprises a plurality of radial bulkheads 70 (see FIG. 26) extending vertically from the top of the column 16. Each bulkhead 70 has a downwardly-angled or chambered shoulder 72 where its radially outward end is joined with its upper edge. The angled shoulders 72 form a plurality of first guide elements, and each of the angled shoulders 72 terminates in an outer edge 73 that is tapered in cross-section, as shown in FIG. 27. A plurality of U-shaped receptacles or brackets 74 is arranged around the periphery of the opening of the leg well 14 on the upper surface of the deck 12. The brackets 74 are located so as to correspond with the circumferential positions of the bulkhead ends.

In a preferred configuration, there are four bulkheads 70, defining a pair of orthogonal diameters. A cap beam 76, dimensioned to bridge the leg well opening, is installed over the leg well 14. The cap beam 76 includes radial arms 77 that are positioned circumferentially in the same positions as are the radially bulkheads 70. In the preferred configuration, the radial arms 17 of the cap beam 76 define two orthogonal diameters corresponding to the diameters defined by the bulkheads 70. A pair of downwardly-extending flanges 78 is provided at the end of each of the beam arms 77. An angled brace or second guide element 80, configured with an angle that is complementary to the chambered shoulder 72 of the corresponding bulkhead 70, is provided on the underside of each beam arm 77 near its end. As shown in FIG. 27, each of the braces or second guide elements 80 is formed with a channel 81 that is configured to receive the tapered edge 73 of its corresponding angled shoulder or first guide element 72.

The upright legs of each bracket 74 are apertured to receive at least one locking pin 82, and preferably two locking pins 82, as shown. The locking pins 82 are movable between an unlocked position and a locked position in which each end of each cap beam arm 77 is locked into the bracket 74 in which it is received. The locking pins 82 may advantageously be moved between their unlocked position and their locked position by a conventional hydraulic or pneumatic mechanism (not shown).

Figure 23:
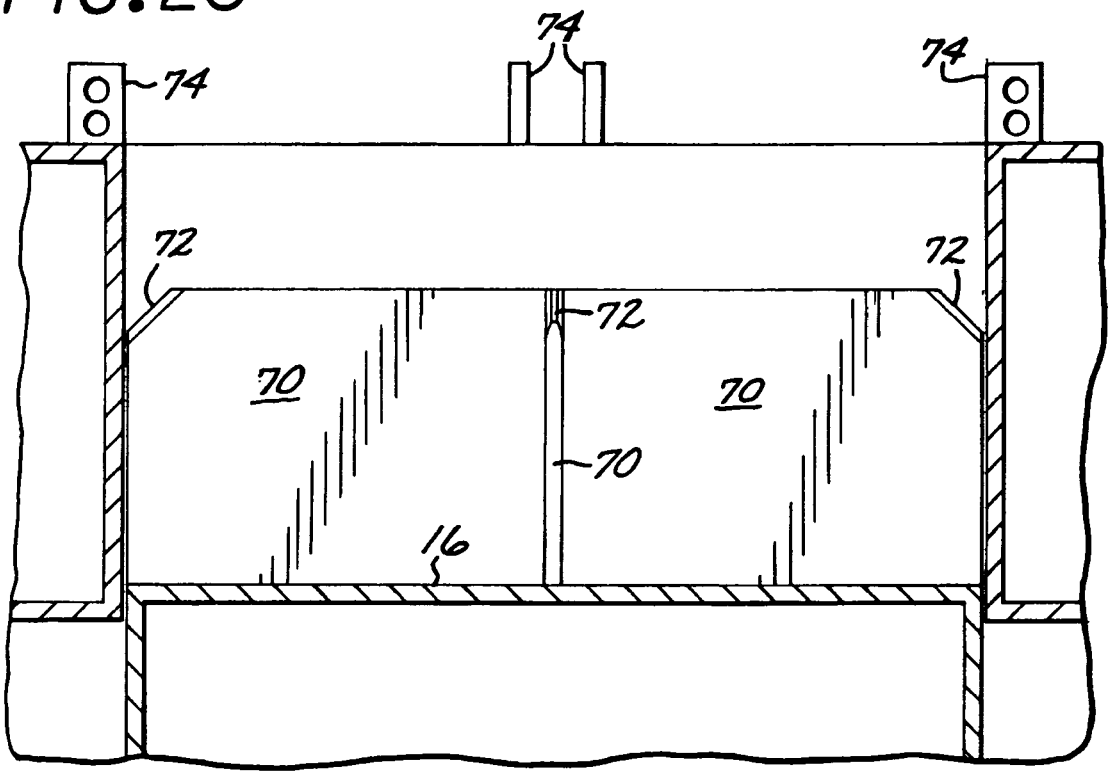
FIG. 23 is a cross-sectional view of a deck-to-column connection assembly in accordance with a fourth exemplary embodiment of the invention, prior to the installation of the cap beams that are included in this embodiment.
Figure 24:
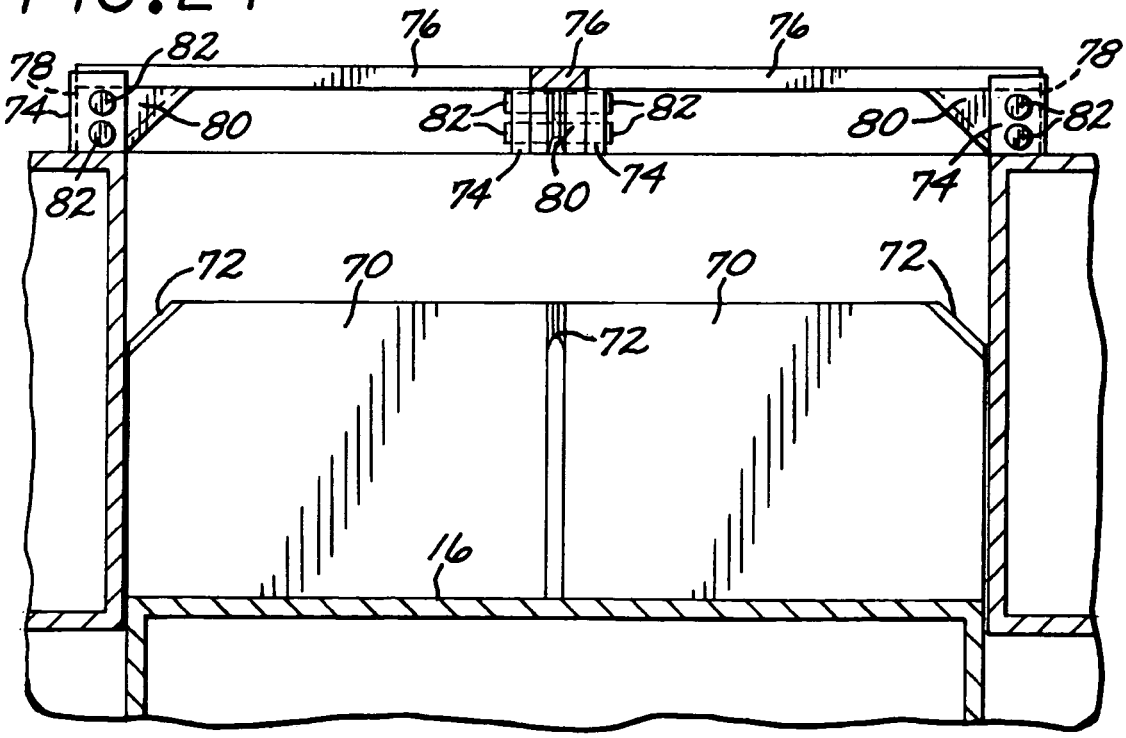
FIG. 24 is a cross-sectional view, similar to that of FIG. 23, showing the assembly after the installation of the cap beams, but before the deballasting (raising) of the column to its connection position.

As shown in FIGS. 23 and 24, the cap beam 76 is installed in the brackets 74 when the column 16 has been over-ballasted to a "sub-operational" position that is somewhat below its operational submerged position. After the cap beam arms 77 have been locked into the brackets 74 by means of the locking pins 82, as described above, the column 16 is raised by partial de-ballasting to lift it into its operational position, in which the edges 73 of the chambered shoulders or first guide elements 72 of the column bulkheads 70 are received in the channels 81 of the second guide elements or braces 80 of the cap beam arms 77 (see FIG. 25), thereby centering the column 16 in the leg well and securing the column 16 to the deck. The column 16 is maintained in this position while the column bulkheads 70 are welded to the deck wall 38 surrounding the leg well 14 at weld joints 84.

From the foregoing, it will be appreciated that the present invention, in its several embodiments, offers an improved EDP with greatly enhanced security in the attachment of the extensible columns to the deck. The enhanced structural security is achieved without detriment to the normal movement of the columns relative to the deck during the column lowering process. Moreover, within the scope of the invention are several embodiments that make the invention widely adaptable to differing conditions, design considerations, and manufacturing methods.

While several embodiments of the invention have been disclosed and described herein, it will be appreciated by those skilled in the pertinent arts that a number of variations and modifications, some of which have been mentioned above, may suggest themselves to those skilled in the pertinent arts. For example, the description herein of specific mechanisms for locking the tops of the columns to the deck surrounding the leg wells should be considered exemplary only, and should not be construed as exclusive of equivalent mechanisms. Other elements of the invention as described herein should also be understood as having functionally and/or structurally equivalent elements that may suggest themselves to those skilled in the pertinent arts. Such variations, modifications, and equivalents should be considered within the spirit and scope of the invention, as defined in the claims that follow.

What is claimed is:

1. An arrangement for securing the deck of an extendable draft platform (EDP) to a buoyancy column that is installed in a leg well in the deck for vertical movement within the leg well from a raised position to a submerged position, the arrangement comprising:

a plurality of first guide elements near the top of the column;

a plurality of complementary second guide elements secured to the deck around the leg well, each of which is configured and located so as to engage an associated one of the first guide elements when the column is lowered to its submerged position; and a locking mechanism that is operable to restrict the motion of the column relative to the deck when the first guide elements are engaged with the second guide elements.

2. The arrangement of claim 1, further comprising:

a first plurality of radial bulkheads extending vertically from the top of the column, each of which has a radially outer end to which is fixed one of the first guide elements; and a second plurality of radial bulkheads extending vertically from the top of the column;

wherein the locking mechanism comprises:

a plurality of receptacles arranged on the deck around the top of the leg well; and a radially extending member on each of the second plurality of bulkheads, each of the radially extending members being lockably engageable with an associated one of the receptacles.

3. The arrangement of claim 2, wherein the radially extending member comprises a locking pin that is movable between a withdrawn position in which it is not engaged with its associated receptacle, and an extended position in which it is received in its associated receptacle; and wherein the locking mechanism further comprises a locking pin actuation mechanism operably associated with each of the locking pins, for moving its associated locking pin from its withdrawn position to its extended position when the first guide elements are engaged with the second guide elements.

4. The arrangement of claim 3, wherein each of the locking pin actuation mechanisms is located on one of the second plurality of bulkheads, the actuation mechanism being selected from the group consisting of a hydraulic cylinder and a pneumatic cylinder.

5. The arrangement of claim 2, wherein each of the radially extending members comprises an extension member fixed to the top of one of the second plurality of bulkheads and extending radially outward therefrom, and wherein the locking mechanism further comprises:

a locking pin selectably receivable in each of the receptacles so as to selectably lock each extension member in its associated receptacle.

6. The arrangement of claim 1, further comprising:

a plurality of radial beams disposed on the top of the column, each of the beams terminating in a radially outer end forming one of the first guide elements; and a plurality of stop elements arranged in the leg well at positions circumferentially corresponding to the circumferential positions of the first guide elements, each of the stop elements having an upper surface forming one of the second guide elements.

7. The arrangement of claim 6, wherein the locking mechanism comprises:

a lower surface on each of the stop elements;

a plurality of shear keys mounted on the top of the column, each of the shear keys extending radially underneath an associated one of the radial beams, the shear keys being movable between a withdrawn position in which they do not engage the stop elements, and an extended position in which they engage the lower surface or the stop elements.

8. The arrangement of claim 7, wherein the locking mechanism further comprises a shear key actuation mechanism for moving the shear keys between the withdrawn position and the extended position, the shear key actuation mechanism being selected from the group consisting of a pneumatic cylinder, a hydraulic cylinder, and a jack screw.

9. The arrangement of claim 1, further comprising:

a plurality of radial bulkheads extending vertically from the top of the column, each of the bulkheads having an upper edge and a radially outer end, with one of the first guide elements defined between the upper edge and the radially outer end; and a cap beam having a plurality of radial arms having circumferential positions corresponding to the circumferential positions of the bulkheads, each of the arms defining one of the second guide elements located so as to be engageable by one of the first guide elements, each of the arms terminating in a radial outer end that is secured to the deck around the leg well.

10. In an extendable draft platform (EDP) having a deck and a plurality of buoyancy columns, each of which is mounted for vertical movement within a leg well through the deck, wherein each column includes a plurality of radially-movable locking members arranged circumferentially thereon, and wherein the deck includes a plurality of locking member engagement elements arranged circumferentially around each of the leg wells in circumferential positions corresponding to the positions of the locking members, a method of installing the EDP at a selected site in a body of water, comprising the steps of:

(a) providing a plurality of first guide elements near the top of each column and providing a plurality of complementary second guide elements around each of the leg wells;

(b) ballasting the columns to move them downward in the leg wells from a fully raised position to a fully lowered position in which the first and second guide elements come into engagement;

(c) locking the columns to the deck after the columns are moved to their fully lowered position by moving the locking members radially outward into a locking engagement with the locking member engagement elements; and (d) over-ballasting the columns to create a compressive engagement between the first and second guide elements.

11. The method of claim 10, wherein the locking step includes the step of welding the columns to the deck within the interior of the leg wells.

12. The method of claim 10, wherein the moving of the locking members is performed by a mechanism selected from the group consisting of pneumatic cylinders, hydraulic cylinders, and jack screws.

13. In an extendable draft platform (EDP), of the type including a deck and a plurality of buoyancy columns installed in leg wells in the deck for vertical movement from a raised position to a submerged position, the improvement comprising:

a plurality of first guide elements near the top of each of the columns;

a plurality of complementary second guide elements fixed to the deck around each of the leg wells, each of the second guide elements being configured and located so as to engage an associated one of the first guide elements when the column is lowered to its submerged position;

a plurality of radially-movable locking members arranged circumferentially on each of the columns;

a plurality of locking member engagement elements on the deck and arranged around each of the leg wells in circumferential positions corresponding to the positions of the locking members; and a locking member actuation mechanism operable on the locking members so as to move the locking members radially outward into a locking engagement with the locking member engagement elements.

14. The EDP of claim 13, further comprising:

a first plurality of radial bulkheads extending vertically from the top of each of the columns, each of the first plurality of bulkheads having a radially outer end to which is fixed one of the first guide elements; and a second plurality of radial bulkheads extending vertically from the top of each of the columns;

wherein each of the locking member engagement elements comprises a receptacle on the deck adjacent the top of the leg well; and wherein each of the locking members comprises a radially extending member on one of the second plurality of bulkheads, each of the radially extending members being lockably engageable with an associated one of the receptacles.

15. The EDP of claim 14, wherein the radially extending member comprises a locking pin that is movable between a withdrawn position in which it is not engaged with its associated receptacle, and an extended position in which it is received in its associated receptacle; and wherein the locking mechanism further comprises a locking pin actuation mechanism operably associated with each of the locking pins, for moving its associated locking pin from its withdrawn position to its extended position when the first guide elements are engaged with the second guide elements.

16. The EDP of claim 15, wherein each of the locking pin actuation mechanisms is located on one of the second plurality of bulkheads, the actuation mechanism being selected from the group consisting of a hydraulic cylinder and a pneumatic cylinder.

17. The EDP of claim 14, wherein each of the radially extending members comprises an extension member fixed to the top of one of the second plurality of bulkheads and extending radially outward therefrom, and wherein the locking mechanism further comprises:

a locking pin selectably receivable in each of the receptacles so as to selectably lock each extension member in its associated receptacle.

18. The EDP of claim 13, further comprising:

a plurality of radial beams disposed on the top of the column, each of the beams terminating in a radially outer end forming one of the first guide elements; and a plurality of stop elements arranged in the leg well at positions circumferentially corresponding to the circumferential positions of the first guide elements, each of the stop elements having an upper surface forming one of the second guide elements.

19. The EDP of claim 18, wherein each of the plurality of locking member engagement elements comprises a lower surface on one of the stop elements; and wherein the plurality of radially movable locking members comprises a plurality of shear keys mounted on the top of the column, each of the shear keys extending radially underneath an associated one of the radial beams, the shear keys being movable between a withdrawn position in which they do not engage the stop elements, and an extended position in which they engage the lower surface of the stop elements.

20. The EDP of claim 19, wherein the locking member actuation mechanism comprises a shear key actuation mechanism for moving the shear keys between the withdrawn position and the extended position, the shear key actuation mechanism being selected from the group consisting of a pneumatic cylinder, a hydraulic cylinder, and a jack screw.

21. In an extendable draft platform (EDP), of the type having a deck and a plurality of buoyancy columns installed in leg wells in the deck for vertical movement from a raised position to a submerged position, the improvement comprising:

a plurality of radial bulkheads extending vertically from the top of each column, each of the bulkheads having a first guide element defined between an upper edge and a radially outer end; and a cap beam having a plurality of radial arms having circumferential positions corresponding to the circumferential positions of the bulkheads, each of the arms defining a second guide element located so as to be engageable by one of the first guide elements, each of the arms terminating in a radial outer end that is secured to the deck around the leg well and defining a second guide element.

22. The EDP of claim 21, wherein each of the first guide elements is formed as an angled shoulder between the upper edge and the radially outer end of one of the bulkheads, the angled shoulder having an outer edge; and wherein each of the second guide elements is formed as a brace including a channel configured to receive the outer edge of the angled shoulder.

23. The EDP of claim 21, wherein each of the cap beam arms terminates in a downwardly depending flange, the EDP further comprising:

a plurality of brackets on the deck around the leg well, located and configured so as to receive the flanges of the cap beam arms; and means for securing each of the flanges to its respective bracket.

24. In an extendable draft platform (EDP) having a deck and a plurality of buoyancy columns, each of which is mounted for vertical movement within a leg well through the deck, a method of installing the EDP at a selected site in a body of water, comprising the steps of:

(a) providing a plurality of first guide elements near the top of each column and providing a plurality of complementary second guide elements around each of the leg wells;

(b) ballasting the columns to move them downward in the leg wells from a fully raised position to a fully lowered position in which the first and second guide elements come into engagement;

(c) guiding the columns to center them in their respective leg wells; and (d) locking the columns to the deck.

25. The method of claim 24, further comprising the step of over-ballasting the columns to create a compressive engagement between the first and second guide elements, prior to the locking step.

26. The method of claim 24, wherein the locking step includes the step of welding the columns to the deck within the interior of the leg wells.

27. The method of claim 24, wherein each column includes a plurality of radially-movable locking members arranged circumferentially thereon, and wherein the deck includes a plurality of locking member engagement elements arranged circumferentially around each of the leg wells in circumferential positions corresponding to the positions of the locking members, and wherein the locking step comprises the step of moving the locking members radially outward into a locking engagement with the locking member engagement elements.

28. The method of claim 27, wherein the step of moving the locking members is performed by a mechanism selected from the group consisting of pneumatic cylinders, hydraulic cylinders, and jack screws.

29. The method of claim 24, wherein, on each column, each of the first guide elements is located at the radial end of a radial bulkhead extending vertically from the top of the column, wherein the step of guiding includes the steps of (c)(1) installing a cap beam over the top of each of the leg wells, the cap beam having the second guide elements located on it so as to be engaged by the first guide elements when the column is raised to bring the bulkheads into engagement with the cap beam; and (c)(2) de-ballasting each of the columns to bring the bulkheads into engagement with the respective cap beams.

30. The method of claim 29, wherein the locking step includes the steps of (d)(1) locking each of the caps beam to the deck after it has been engaged by the bulkheads; and (d)(2) welding the columns to the deck within the interior of the leg wells.

* * * * *